United States Patent [19]

Finger

[11] Patent Number: 4,712,979

[45] Date of Patent: Dec. 15, 1987

[54] SELF-RETAINED PLATFORM COOLING PLATE FOR TURBINE VANE

[75] Inventor: Stephen N. Finger, Jupiter, Fla.

[73] Assignee: The United States of America as represented by the Secretary of the Air Force, Washington, D.C.

[21] Appl. No.: 797,581

[22] Filed: Nov. 13, 1985

[51] Int. Cl.[4] ..... F01D 5/08

[52] U.S. Cl. ..... 416/96 R; 415/115

[58] Field of Search ..... 415/115, 116, 117; 416/95, 96 R, 97 R, 90, 92

[56] References Cited

U.S. PATENT DOCUMENTS

| | | | |
|---|---|---|---|
| 2,991,045 | 7/1961 | Tassoni | 415/135 |
| 3,300,178 | 1/1967 | Rizk et al. | 415/117 |
| 3,423,071 | 1/1969 | Noren | 514/549 |
| 3,583,824 | 6/1971 | Smuland | 415/134 |
| 3,628,880 | 12/1971 | Smuland | 416/97 R |
| 3,899,267 | 8/1975 | Dennis et al. | 416/96 |
| 3,966,357 | 6/1976 | Corsmeier | 416/97 R |
| 4,013,376 | 3/1977 | Bisson et al. | 415/139 |
| 4,025,226 | 5/1977 | Hovan | 415/115 |
| 4,142,827 | 3/1979 | Vinciguerra | 415/189 |
| 4,177,004 | 12/1979 | Riedmiller et al. | 415/116 |
| 4,285,633 | 8/1981 | Jones | 415/191 |
| 4,288,201 | 9/1981 | Wilson | 415/115 |
| 4,350,473 | 9/1932 | Dakin | 416/96 R |

FOREIGN PATENT DOCUMENTS

| | | | |
|---|---|---|---|
| 545792 | 9/1958 | Canada | 416/96 |
| 680014 | 10/1952 | United Kingdom | 416/96 |
| 738656 | 10/1955 | United Kingdom | 416/96 |

*Primary Examiner*—Abraham Hershkovitz
*Assistant Examiner*—John T. Kwon
*Attorney, Agent, or Firm*—Fredric L. Sinder; Donald J. Singer

[57] ABSTRACT

A turbine stator vane assembly for gas turbine or turbojet engines has an improved structure for retention of a cooling impingement plate. Two inwardly directed flanges are added to the wall-like extensions extending from the bottom of the platform upon which the vane is mounted. The cooling impingment plate is resiliently snapped into place between pin fins on the bottom of the platform and the flanges.

4 Claims, 5 Drawing Figures

SELF-RETAINED PLATFORM COOLING PLATE FOR TURBINE VANE

RIGHTS OF THE GOVERNMENT

The invention described herein may be manufactured and used by or for the Government of the United States for all governmental purposes without the payment of any royalty.

BACKGROUND OF THE INVENTION

This invention relates generally to the field of stator vane assemblies in gas turbine or turbojet engines, and more particularly to an improved mounting assembly for impingement cooling plates.

In conventional gas turbine engines, gases, generally atmospheric air, are compressed in a compression section of the engine and then flowed to a combustion section where fuel is added and the mixture burned to add energy to the flowing gases. The now high energy combustion gases are then flowed to a turbine section where a portion of the energy is extracted and applied to drive the engine compressor.

The turbine section includes a number of alternate rows of fixed stator vanes and moveable rotor blades. Each row of stator vanes directs the combustion gases to a preferred angle of entry into the downstream row of rotor blades. The rotor blades in turn extract energy from the combustion gases for driving the engine compressor.

The combustion gases are very hot, creating a need for cooling of the stator vanes and turbine blades. Part of the cooling requirements for the stator vanes is provided by passing cooling air over the base of the platform to which each stator vane is attached. For more efficient cooling, an impingement cooling plate is placed between the base of each platform and the cooling air source. The impingement cooling plates are perforated so that the cooling air is redirected to form jets of air impacting perpendicularly to the platform bases. This increases the cooling over what would result if the cooling air merely passed over the base of each platform. Other designs align the perforation holes to direct the jets of cooling air in other advantageous directions; for example, to direct cooling air to particular hot spots.

Prior art impingement cooling plates are typically welded to the platform bases at the plate edges. These welds add a manufacturing expense and create a thermal fight between the plate and the platform when the turbine is operated. The thermal fight can cause weld cracks. The welds also make repairs more difficult.

With the foregoing in mind, it is, therefore, a principal object of the present invention to provide an impingement cooling plate mounting assembly with a lower manufacturing cost, easier repairability and increased reliability over welded-in-place impingement cooling plates.

SUMMARY OF THE INVENTION

In accordance with the foregoing principles and objects of the present invention, a novel mounting assembly for impingement cooling plates on turbine stator vane platforms is described which utilizes retaining flanges and cooling pins to provide a snap-fit for a flexible sheet metal impingement cooling plate. The snap fit provides positive contact between the impingement cooling plate and the retaining flanges and between the impingement cooling plate and the cooling pins.

BRIEF DESCRIPTION OF THE DRAWINGS

The present invention will be more clearly understood from a reading of the following detailed description in conjunction with the accompanying drawings.

DETAILED DESCRIPTION OF THE INVENTION

Figure 1:
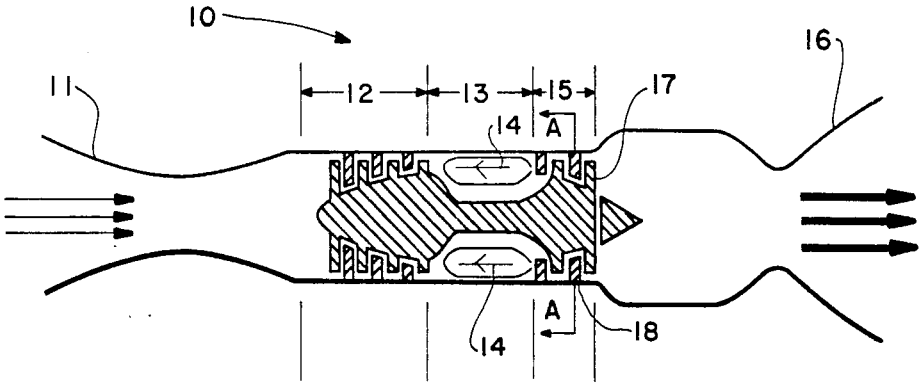
FIG. 1 is a schematic drawing of a gas turbine engine showing the location of the turbine stator vane assemblies.

Referring now to FIG. 1 of the drawings, there is shown a gas turbine or turbojet engine 10, which has an air inlet 11, a compressor section 12, a combustion section 13 enclosing combustion chambers 14, a turbine section 15, and an exhaust duct 16.

In operation, air enters the engine 10 through the air inlet 11, is compressed as it passes through the compressor section 12, is heated in a power generating function by combustion chambers 14 as its passes through the combustion section 13, then passes through the turbine section 15 in a power extraction function, and, finally, is exhausted in jet fashion through the exhaust duct 16. The compressor section 12 derives its power from a shaft connection to the turbine section 15. The turbine section 15 includes a plurality of alternate rows of rotor blades 17 and stator vanes 18. Each row of stator vanes, comprised of a plurality of turbine vane assemblies connected together to form a fixed ring, directs working medium gases from the combustion section 13 into a downstream rotatable ring of rotor blades 17. The rotor blades 17 then extract energy from the combustion gases to rotate the shaft that drives the compressor section 12.

Figure 2:
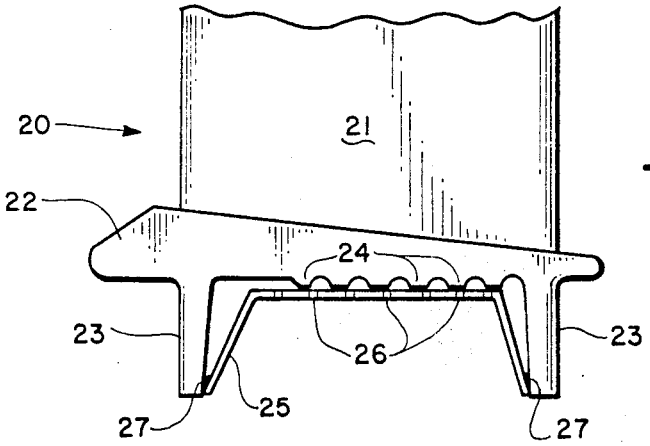
Fig. 2 PRIOR ART
FIG. 2 is a cross-sectional view of an example prior art turbine stator vane platform.

FIG. 2 shows a cross-sectional view of an example of the bottom portion of a prior art turbine stator vane 20, which has a blade-shaped vane 21 mounted on a wider platform 22, pin fins 24, and an impingement cooling plate 25. The platform further includes wall-like extensions 23. The impingement cooling plate includes holes 26, and is welded to the platform 22 by welds 27.

Figure 3:
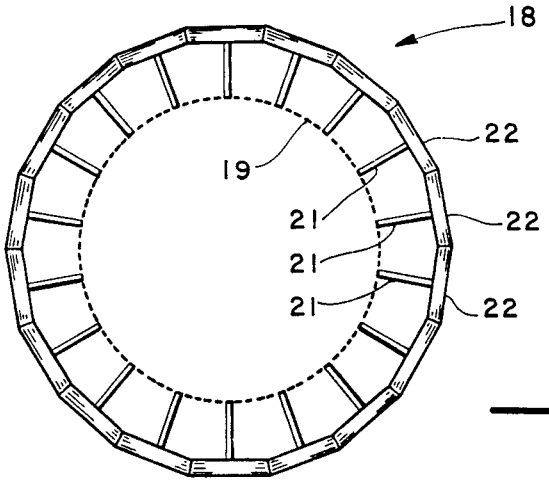
FIG. 3 is a schematic cross-sectional drawing of a view taken along line A—A of FIG. 1 of one row of turbine stator vane assemblies only.

FIG. 3 shows a schematic cross-sectional view taken along line A—A of FIG. 1 of a row of turbine stator vane assemblies. The stator vane assemblies are arranged with each vane platform 22 abutting its adjacent vane-carrying platform at a slight angle to their vertical axes so that a sufficient number of stator vanes and platforms form a ring. In a typical gas turbine, the angle between adjacent platforms is such that the ring has the stator vanes facing inward and the platforms facing outward and attached to the inside circumference of the outer wall assembly of the gas turbine. In most gas turbine engines, the vanes are additionally connected at their other ends, as shown by the representative dashed line 19, to form an annular path for the combustion gases.

In operation, other passageways (not shown) deliver cooling air to the channel area beneath the impingement cooling plate 25 at a higher pressure than the air between the impingement cooling plate and the bottom of the platform. The higher pressure forces air through the holes 26 which redirect the cooling air into jets which impinge upon the bottom of the platform 22, thereby cooling the platform 22 which has absorbed heat conducted from the vane 21 in contact with the hot combustion gases from the combustion section 13. The impingement process increases the efficiency of the cooling process over simple surface flow cooling by providing greater cooling for the same amount of air transport. The efficiency is a factor of both hole size and the distance of the holes from the surface to be cooled. The pin fins 24 serve to both hold the impingement cooling plate at the optimium distance from the platform surface and to provide additional surface area for contact with the cooling air and to thereby improve cooling.

Figure 4:
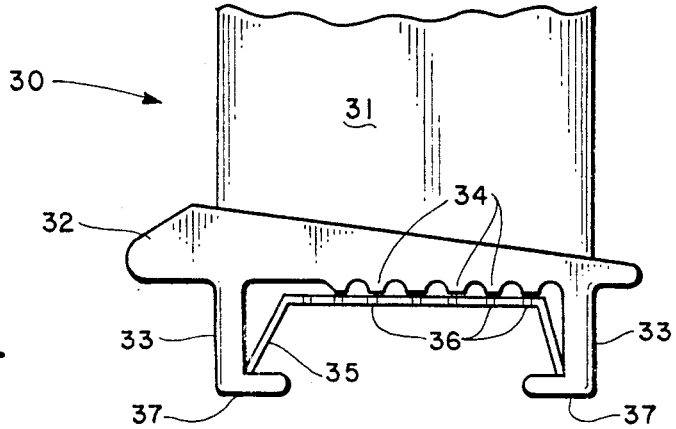
FIG. 4 is a cross-sectional view of turbine stator vane platform incorporating the present invention.
Figure 5:
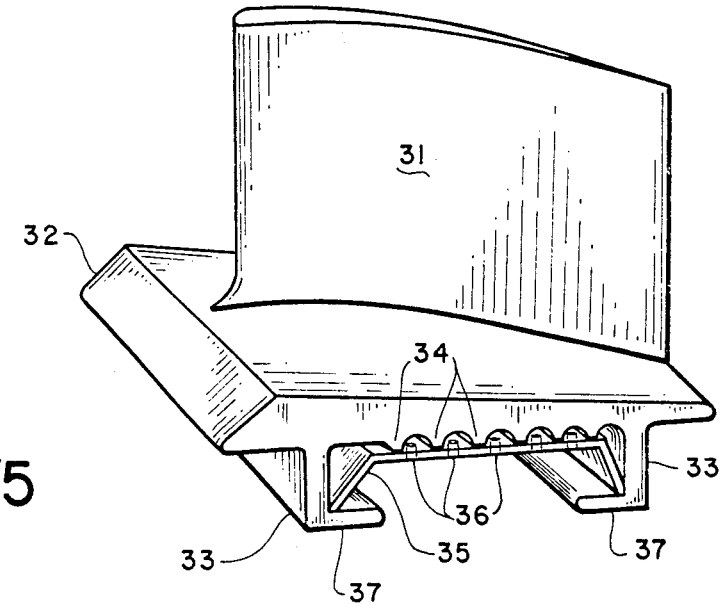
FIG. 5 is a perspective view of the turbine stator vane platform incorporating the present invention.

Referring now to FIGS. 4 and 5, there is shown a cross-sectional and a perspective view of the bottom of a turbine stator vane 30 assembly incorporating the present invention. The vane assembly has a blade-shaped vane 31, a platform 32 with wall-like extensions 33, cast in place pin fins 34, and an impingement cooling plate 35. The platform extensions 33 additionally include cast in place retaining flanges 37. The holes 36 are present in the impingement cooling plate 35 to redirect cooling air to the bottom of the platform as previously described.

Unlike the welds of the prior art, the impingement cooling plate 35 is formed of a resilient sheet metal and snapped into place between the flanges 37 and the pin fins 34 without welds. The flanges 37 shown in this embodiment are full length, but may be interrupted, for example, as tabs, with the same good effect. An example of a suitable impingement cooling plate material is a nickle-based sheet metal alloy such as Inconel 625, of thickness 0.010 to 0.015 inches. The resiliency of the impingement cooling plate 35 material provides a positive pressure load to ensure sealing against the inside of the flanges 37 and to hold the plate in positive contact with the pin fins 34 to ensure an adequate impingement gap during operation. The continuous positive pressure sealing eliminates the manufacturing difficulty of welding the impingement cooling plate in place and avoids the concern with the thermal fight between the weld and the plate and platform causing cracks in the weld. In addition to the inherent increased reliability of this new design, repairs, if ever needed, are made much simpler by this snap-in design.

It is understood that certain modifications to the invention as described may be made, as might occur to one with skill in the field of this invention, within the scope of the claims. Therefore, all embodiments contemplated have not been shown in complete detail. Other embodiments may be developed without departing from the spirit of the invention or from the scope of the appended claims.

I claim:

1. A stator vane assembly, comprising;

(a) a platform having upper and lower surfaces and leading and trailing edges;

(b) a vane attached to the platform upper surface;

(c) pin fins defined on the platform lower surface;

(d) first and second wall means defined on the platform lower surface respectively near said leading and trailing edge and defining a channel between said first and second wall means;

(e) inwardly extending retaining flanges on each wall means, spaced a predetermined distance from the platform lower surface, and formed as permanently fixed in place integral extensions of said first and second wall means; and, (f) a cooling impingement plate comprising a substantially flat sheet of resilient material having first and second downwardly slanted bent edges on opposite sides of said sheet, the sheet positioned inside said channel against said pin fins and the downwardly slanted bent edges resiliently biased against said wall means; and, whereby said impingement cooling plate can be inserted and removed only by deformation of the impingement cooling plate.

2. The stator vane assembly as described in claim 1, wherein the cooling impingement plate comprises sheet metal.

3. The stator vane assembly as described in claim 2, wherein the resiliency of the sheet metal provides a positive pressure load to seal the cooling impingement plate against said first and second wall means.

4. The stator vane assembly as described in claim 3, wherein the cooling impingement plate is shaped to contact all the pin fins.

* * * * *